US005966902A

United States Patent [19]

Korycki

[11] Patent Number: 5,966,902

[45] Date of Patent: Oct. 19, 1999

[54] PAINT ROLLER COVER

[76] Inventor: Rodney J. Korycki, 10 Foxwood Dr., Saginaw, Mich. 48603

[21] Appl. No.: 09/064,989

[22] Filed: Apr. 23, 1998

Related U.S. Application Data

[60] Provisional application No. 60/044,558, Apr. 24, 1997.

[51] Int. Cl.[6] ..... B65B 7/26; B65D 41/18; B65D 41/28

[52] U.S. Cl. ..... 53/397; 53/594; 206/209; 206/361

[58] Field of Search ..... 53/397, 594; 206/209, 206/229, 209.1, 362.1, 361, 362.2, 362.3, 362.4, 15.2, 15.3

[56] References Cited

U.S. PATENT DOCUMENTS

| | | | |
|---|---|---|---|
| 3,127,985 | 4/1964 | Scott | 206/362.3 |
| 4,638,910 | 1/1987 | Bokmiller | 206/15.2 |
| 4,940,139 | 7/1990 | Sandt | 206/362.3 X |
| 5,074,098 | 12/1991 | Filipchuk | 53/397 |
| 5,138,738 | 8/1992 | Nicholson | 15/247 |
| 5,178,274 | 1/1993 | Long | 206/361 |
| 5,440,853 | 8/1995 | Engdahl | 53/432 |
| 5,533,617 | 7/1996 | Von Flatern | 206/361 |
| 5,540,363 | 7/1996 | Wilson | 206/15.3 X |
| 5,645,164 | 7/1997 | Hocking | 206/209 |
| 5,709,301 | 1/1998 | Couch et al. | 206/361 |
| 5,797,410 | 8/1998 | Gates | 206/15.3 X |

*Primary Examiner*—James F. Coan

*Attorney, Agent, or Firm*—Reising, Ethington, Barnes, Kisselle, Learman & McCulloch, P.C.

[57] ABSTRACT

A paint roller cover for protecting a wet paint roller element from drying out when not in use includes upper and lower half sections joined along a common edge by a hinge and each formed with a corresponding depression that, when the halves are closed upon one another, defines an enclosed elongate chamber between the halves of such size and shape to accommodate a roller element. At one end of the chamber, the mating walls of the half sections are formed with opposed semicircular recesses that, when the half sections are brought together, align to form an opening of such size and position to accept the rod of the roller handle. The cover is further provided with a means of locking the half sections securely but releasably in the closed position once installed about the roller. The half sections may be conveniently molded as one piece from plastics materials, joined across a living hinge and carrying interlocking formations that engage when the halves are brought together to lock the cover closed.

18 Claims, 3 Drawing Sheets

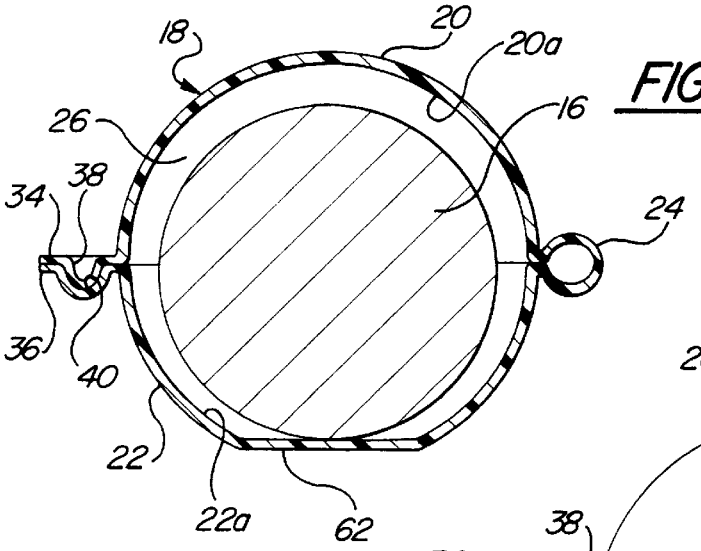
FIG-4
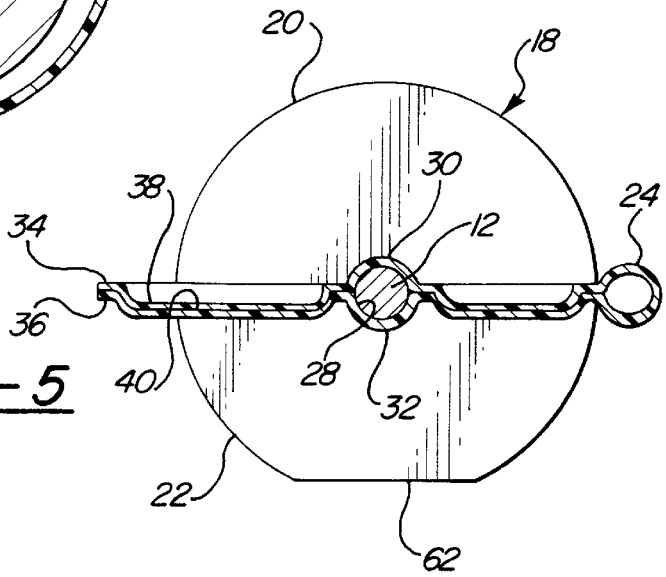
FIG-5
FIG-6
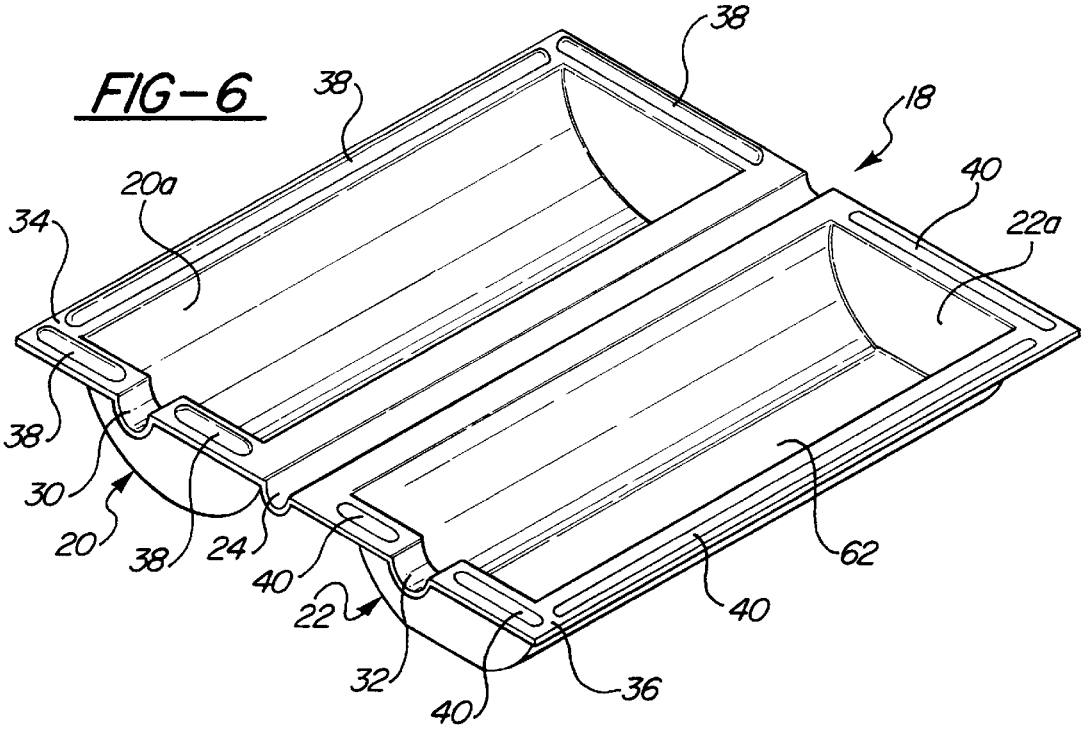

PAINT ROLLER COVER

This application claims benefit of provisional application Ser. No. 60/044,558, filed Apr. 24, 1997.

This invention relates generally to protective covering devices used by painters to cover a paint roller wetted with paint to prevent it from drying out when not in use.

BACKGROUND OF THE INVENTION

Paint is often applied to a wall using a paint roller tool or assembly. Such paint roller tools usually include a long handle and a rigid, transversely bent rod secured to the end of the handle and journalling a rotatable roller support. A tubular paint roller element is removably mountable onto the roller support for rotation therewith. The roller element has a rigid tubular core usually made of cardboard and an outer, fibrous, napped pile or surface which is capable of holding a substantial quantity of paint for application to the wall.

It is well recognized that applying paint to a wall in such manner is fast, efficient, and achieves a good finish. However, it is also well recognized that the roller elements take considerable time to clean in order to remove all of the paint from the nap and prevent ruining the roller element for future use. Cleaning paint from a roller is very messy and tedious. Often, this task is one that is neglected by homeowners and professional painters alike.

It is not unusual for painters who are involved in a painting project and who must stop temporarily (i.e., for a few hours or overnight) to forego washing the paint out the roller element, and instead, out of convenience to wrap the roller element in a plastic bag or plastic film or aluminum foil to protect the roller from drying. However, such plastic bags, films and foils can likewise be messy and difficult to deal with. It can be difficult to achieve an adequate seal to prevent drying and leakage.

A paint roller cover constructed according to the invention overcomes or greatly minimizes the problems associated with using a plastic bag, film or aluminum foil to protect a roller.

SUMMARY OF THE INVENTION

A paint roller cover constructed according to the invention includes upper and lower half cover sections joined along a common edge by a hinge and each formed with a corresponding depression that, when the halves are closed upon one another, define an enclosed elongate chamber between the halves of such size and shape to accommodate a roller element. At one end of the chamber, the mating walls of the half sections are formed with opposed semicircular recesses that, when the half sections are brought together, align to form an end opening of such size and position to accept the rod of the paint roller tool. The cover is further provided with a means of locking the half sections securely but releasably in the closed position once closed about the roller.

The half sections may be conveniently molded as one piece from plastics materials joined across a living hinge, and carrying interlocking formations that engage when the halves are brought together to lock the cover closed. The cover thus has the advantage of providing hinged halves which are preformed to shape to accommodate the roller element and rod, eliminating the need to wrap a bag, film or foil about the roller and the mess associated therewith. All that a user need do is simply open the cover, insert the roller into the depression of one of the halves, and close the other half about the roller and lock it closed. When the user desires to use the roller at a later time, all he need to is unlock the cover, hinge it open and lift the roller free of the cover. The cover of the invention has the further advantage of being readily washable and reusable.

BRIEF DESCRIPTION OF THE DRAWINGS

Presently preferred embodiments of the invention are disclosed in the following description and in the accompanying drawings, wherein:

FIGS. 4 and 5 are cross-sectional views taken generally along lines 4—4 and 5—5 of FIG. 3, respectively;

FIG. 6 is a perspective view of the paint roller cover of FIG. 2 shown in the open condition;

DETAILED DESCRIPTION

Figure 1:
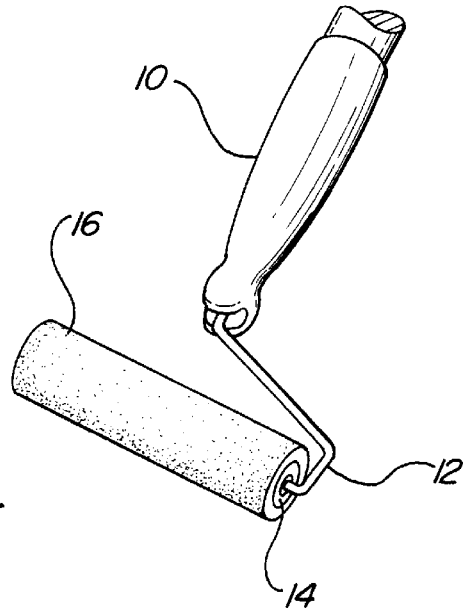
FIG. 1 is a fragmentary perspective view of a typical paint roller tool for use in connection with the paint roller cover of the invention.

FIG. 1 illustrates a typical paint roller used to roll paint onto a wall or other surface and includes a handle 10 from which a transversely bent, L-shaped metal rod 12 extends journaling at its free end a freely rotatable roller support 14 for supporting a tubular paint roller element 16 of the usual type having a tubular rigid core of cardboard or the like and a fibrous, napped surface or pile capable of holding a substantial quantity of paint to be applied to a wall or other surface.

The remaining FIGS. 2–10 illustrate various embodiments of a paint roller cover 18 constructed according to the present invention.

Figure 2:
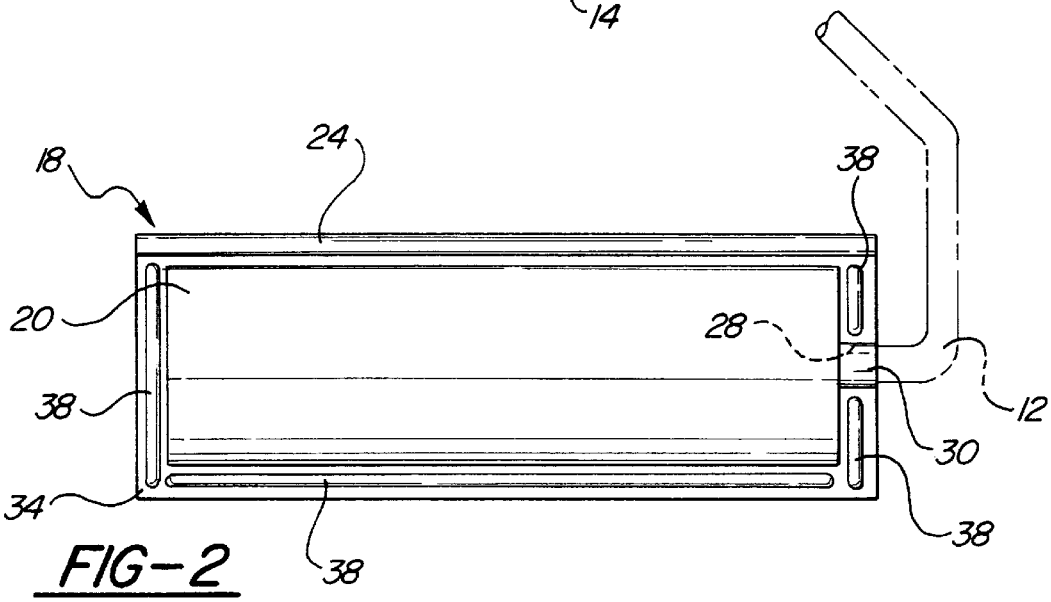
FIG. 2 is a top plan view of a paint roller cover constructed in accordance with a first embodiment of the invention shown as it would be mounted on the paint roller of FIG. 1.
Figure 3:
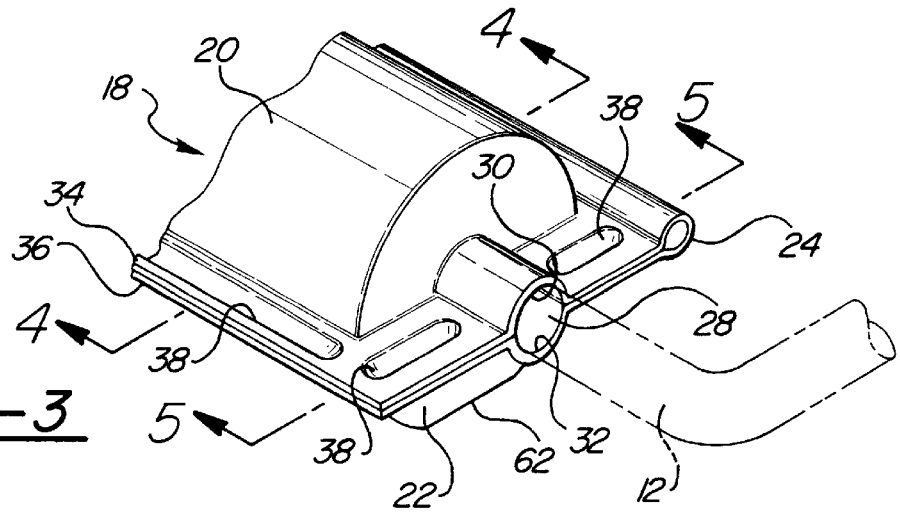
FIG. 3 is an enlarged, fragmentary perspective view of the cover of FIG. 2 showing various features of the invention.

As shown best in FIGS. 2, 3, and 6, the cover 18 of a first embodiment comprises a one piece molded plastics article having an upper half 20 and a lower half 22 joined across an integral web or living hinge 24, and each formed with a corresponding depression 20*a*, 22*a* that, when the halves, 20, 22 are closed upon one another, defines an enclosed elongate chamber or space 26 between the halves 20, 22 of such size and shape to accommodate the roller element 16.

At one end of the chamber 26 is a centrally located opening 28 that is of such size and position to accept the rod 12 of the roller handle 10. The opening 28 is defined by semi-circular walls 30, 32 formed in the upper and lower halves 20, 22 of the cover 18, respectively that, when the halves are brought together, align to form the opening 28.

Each of the embodiments of the cover is provided with a means of locking the cover halves 20, 22 releasably in the closed position by the provision of matable closure parts carried by the cover halves 20, 22. In the first embodiment of FIGS. 2–6, the cover halves 20, 22 are formed with peripheral flanges 34, 36 that align face-to-face when the halves 20, 22 are closed. To lock the halves 20, 22 together, the flanges 34, 36 are formed with interlocking male and female channel formations 38 40 that, as illustrated in FIGS. 3–5, nest when forced together and are somewhat resilient to join with a snap-lock fit to hold the cover 18 closed. The flanges 34, 36 and their locking portions 38, 40 are shown extending along the front and side edges of the cover 18 when in the closed position and the locking portions 38, 40 are further illustrated in the form of elongate channels that extend generally the full length of the flanges 34, 36.

Figure 7:
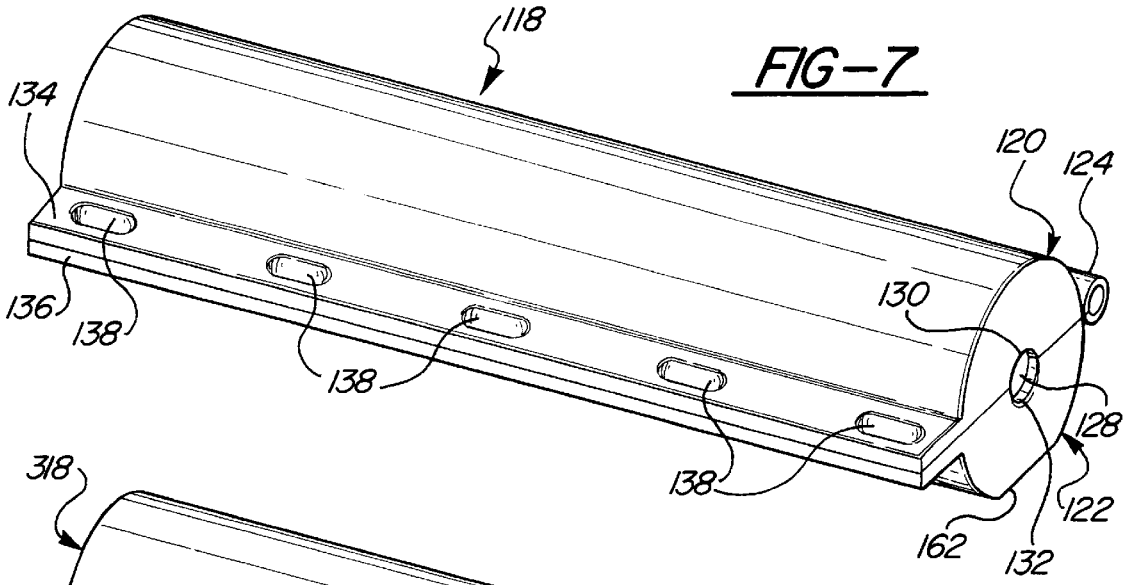
FIGS. 7 and 8 are perspective views of two alternative embodiments of paint roller covers constructed in accordance with the invention.

While such is preferred, FIG. 7 illustrates an alternative embodiment wherein like reference numerals are used to represent like features, but are offset by 100, and wherein the side flange portions are eliminated and the locking portion along the front flange region are in the form of spaced interlocking button formations rather than a continuous channel.

Figure 10:
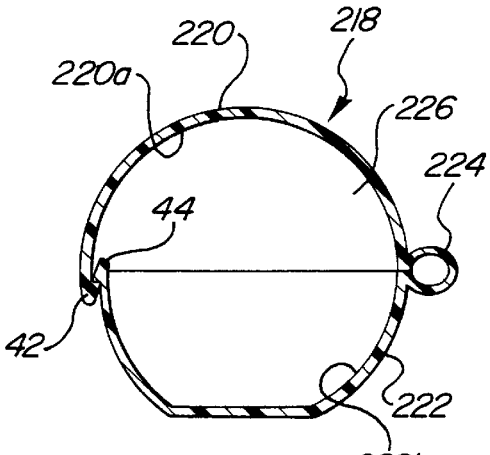
FIG. 10 is a cross-sectional view of an additional embodiment of paint roller cover of the invention.

FIG. 10 shows still a further embodiment in which the same reference numerals are used to designate like features, but are offset by 200 and in which an alternative lock construction is shown for locking the halves 20,22 in the closed position. Rather than channel or button indentations, the flanges are altogether eliminated and the adjoining edges of the cover halves 220, 222 opposite the hinge 224 are formed with interlocking barb projections 42, 44 that hold the cover 218 releasably closed. The projections 42, 44 may extend the full length of the front edge of the cover 218 or may be in the form of one or more sets of such projections spaced across the front of the cover 218.

Figure 8:
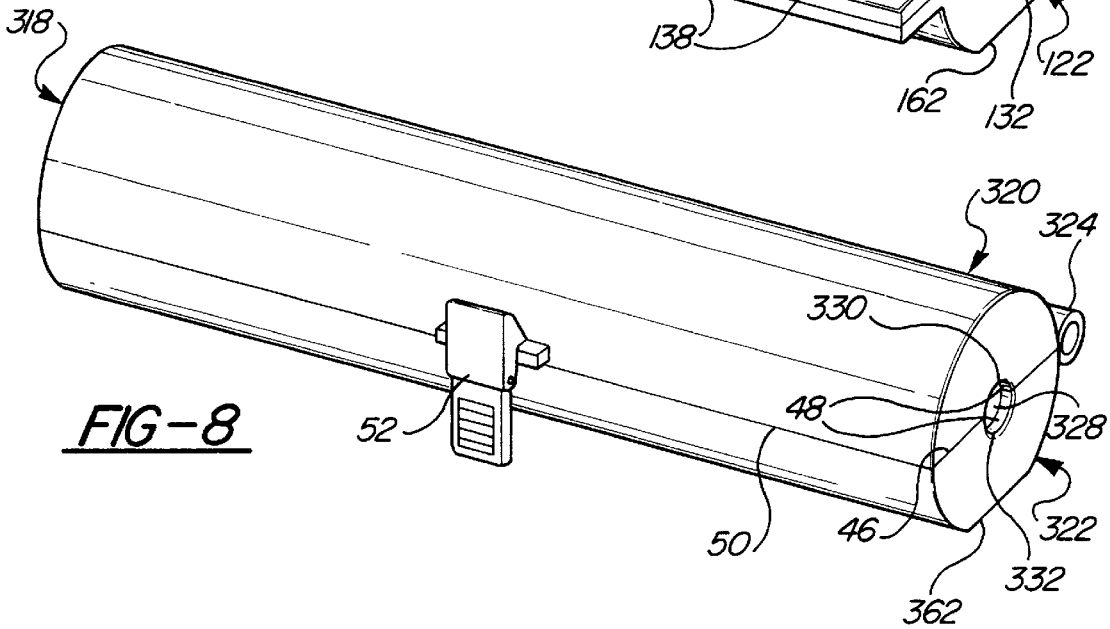
Figure 9:
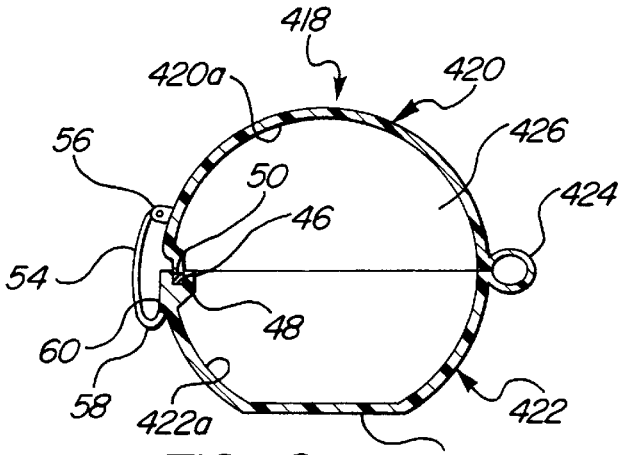
FIG. 9 is a cross-sectional view of another embodiment of the invention.

FIGS. 8 and 9 illustrate still further embodiments of the invention in which like reference numerals are used to indicate like features, but are offset by 300 and 400 respectively. The cover 318 likewise lacks the flanges and interlocking male and female projections of the first embodiment. The lower cover half 320, 420 is formed along its free edge with a channel 46 in which a sealing member 48 is installed. The free edge 50 of the upper cover half 322, 422 is formed to align with the channel 46 of the lower half 322, 422 such that when the halves 320, 322; 420, 422 are closed, the edge 50 extends into the channel 46 and confronts the sealing member 48 in the channel 46. The purpose of the sealing member 48 is to render the cover 318, 418 completely or nearly airtight when closed. As such, it is preferred that the channel and sealing member 46, 48 extend to the semi-circular portions 330, 332; 430, 432 of the cover halves 320, 322; 420, 422 as well as to seal about the rod 12 of the paint roller handle 10. The seal member 48 may comprise a rubber strip or rope extending continuously along the channel 46 and preferably removable therefrom to accommodate washing of the cover 318, 418 and sealing member 48 to remove paint. Other materials may also be used, such as foamed rubber, preferably of the closed cell type so that it does not absorb paint, water, or solvents during use of while being cleaned.

FIGS. 8 and 9 further show additional lock constructions that may be used to retain the cover halves releasably in the closed position. The lock 52 of FIG. 8 is in the form of a toggle latch of the general type used on tool boxes, fishing tackle boxes, etc., whereas the lock 54 of FIG. 9 comprises a spring form metal or plastics piece hinged at its upper end 56 to the upper cover half 420 and formed at its lower end with a hook-like projection 58 that engages a corresponding locking projection 60 of the lower cover half 422 with a snap lock fit. An inward flattening force applied to the spring form member 54 acts to move the hook projection 58 out of engagement with the locking projection 60 for opening the cover 418.

In use, and with reference to the first embodiment with it being understood that the same procedure applies to the other embodiments, when a person is finished painting with the roller element 16 and expects to return to painting in the near future (i.e., within a few hours or a couple of days), rather than washing the paint out of the roller element 16 or wrapping it in foil or plastic wrap as painters often do, the user may simply install the cover 18 about the roller element 16.

With the cover 18 open, as illustrated in FIG. 6, the user positions the roller element 16 within one or the other chamber halves 20*a*, 22*a* orienting the rod 12 of the roller handle 10 such that it is received in the semi-circular wall of the cover half in which it is installed. The user then simply hinges the other cover half over top of the roller element 16 and locks the cover 18 closed. As shown in FIGS. 2 and 3, the cover 18 serves to completely enclose the roller element 16 while as the same time accommodating the rod 12 of the roller handle 10. FIG. 5 further illustrates how the handle 12 is accommodated in the opening 28 of the cover halves 20, 22. The cover thus protects the roller element 16 from exposure to air which would tend to dry the paint held by the roller element which would render it useless.

The embodiments of FIGS. 7–10 operate in the same way and with the sealing member 48 of the embodiments of FIGS. 8 and 9 further blocking any air from entering the chamber once the cover is closed.

It is preferred that the lower half 22 of the cover 18 (of each embodiment) be formed with a lower flat region or bottom 62 spaced from the wings 24 that allows the cover 18 to be placed on the floor or other support surface in a way that supports the confronting flanges or edges of the cover halves 20, 22 generally horizontal to minimize the possibility of paint leaking from the cover in those regions. It is contemplated that both halves of the cover could be formed with such flattened bottom regions.

The disclosed embodiments are representative of presently preferred forms of the invention, but are intended to be illustrative rather than definitive thereof. The invention is defined in the claims.

I claim:

1. A paint roller cover for disposition about a tubular roller element of a paint roller tool having a handle with a transversely bent rod and a rotatable roller support journaled on the rod and removably mounting the roller element for protecting the roller element against drying when wetted with paint, said construction comprising:

an upper half section having a depression formed therein;

a lower half section having a corresponding depression formed therein;

a hinge joining said sections along a common edge enabling said sections to be positioned between an open position for receiving the roller element into one of said depressions while still mounted on the roller support, and a closed position in which said half sections are brought together about the roller element to define an enclosed chamber by said depressions of such size and shape to accommodate the roller element within said cover;

matable closure parts carried by said half sections and operative to secure said cover releasably in said closed position; and a pair of opposed recesses formed in said half sections at one end thereof that, when said cover is closed, define a side opening in said cover of such size and position to close about and accept the rod of the roller tool.

2. The paint roller cover of claim 1 wherein said halves and said hinge are formed as one piece and to shape from a single piece of molded plastics material.

3. The paint roller of claim 2 wherein said hinge comprises an integral web extending between said half sections defining a living hinge of said cover.

4. The paint roller of claim 2 wherein said matable closure parts comprise integrated formations formed as one piece with said half sections.

5. The paint roller cover of claim 4 wherein said integrated formations comprise interlocking male and female portions operative to nest with one another when said cover is closed.

6. The paint roller cover of claim 5 wherein said male and said female portions are resilient and join with a snap-lock fit.

7. The paint roller cover of claim 1 wherein said matable closure parts comprise interlocking barb projections.

8. The paint roller cover of claim 1 wherein said matable closure parts comprise a toggle latch.

9. The paint roller cover of claim 1 wherein said matable closure parts comprise a spring latch.

10. The paint roller cover of claim 1 wherein said cover halves have free edges that confront when said cover is closed, and including a resilient seal element disposed between and compressed by said edges when said cover is closed.

11. The paint cover of claim 10 wherein one of said free edges comprises a channel and said seal is installed in said channel.

12. The paint roller cover of claim 11 wherein said seal is selectively removable from said channel.

13. The paint roller cover of claim 1 wherein at least one of said cover halves has a flattened bottom wall.

14. The paint roller cover of claim 13 wherein said flattened bottom wall is spaced from said hinge.

15. The paint roller cover of claim 1 wherein said side opening is generally circular.

16. The paint roller cover of claim 1 wherein said hinge comprises a living hinge and extends continuously along said common edge of said cover halves providing a fluid tight seal along said common edge.

17. A paint roller cover for disposition about a tubular roller element of a paint roller tool having a handle with a transversely bent rod and a rotatable roller support journaled on the rod and removably mounting the roller element for protecting the roller element against drying when wetted with paint, said construction comprising:

a single piece of molded plastic material having an upper half section formed with a depression, a lower half section formed with a corresponding depression, and a living hinge portion joining said sections along a common edge thereof enabling said sections to be positioned between an open position for receiving the roller element into one of said depressions while still mounted on the roller support, and a closed position in which said half sections are brought together about the roller element to define an enclosed chamber by said depressions of such size and shape to accommodate the roller element within said cover, said one piece cover including integral interlocking closure portions formed along free edges of said cover halves operative to releasably engage one another upon bringing said cover halves together to lock said cover releasably in said closed position, said one piece cover further including a pair of opposed recesses formed in said half sections at one end thereof that, when said cover is closed, define a side opening in said cover of such size and position to close about and accept the rod of the roller tool thereby enabling the roller element to be accommodated within said closed cover while still mounted on the roller support of the paint roller tool.

18. A method of protecting a wet roller element of a paint roller tool from drying out when not in use and while mounted on a rotatable roller support of the tool journaled by a transversely bent rod of a handle of the tool extending from one end of the roller element, said method comprising the steps of:

providing a paint roller cover having an upper half section with a depression formed therein, a lower half section with a corresponding depression formed therein, a hinge joining the half sections along a common edge enabling the half sections to be positioned between an open position for receiving the roller element into the cover while still mounted on the roller support, and a closed position in which the half sections are brought together about the roller element to define an enclosed chamber by the depressions of such size and shape to accommodate the roller element within said cover, closure portions operative to secure the cover releasably in the closed position, and a pair of opposed recesses formed between the half sections at one end thereof that, when the cover is closed, define a side opening in the cover of such size and position to close about the accept the rod of the roller tool;

initially placing the cover in the open position;

positioning the roller element in the depression of one of the half sections and aligning the rod of the paint roller tool with the recess of the one half section; and bringing the half sections together about the roller element and rod and locking the cover closed such that the roller element is accommodated within the chamber of the cover and the rod is accommodated within the side opening of the cover.

* * * * *